US009058005B2

(12) United States Patent
Herrmann

(10) Patent No.: US 9,058,005 B2
(45) Date of Patent: Jun. 16, 2015

(54) METHODS, APPARATUS, AND SYSTEMS FOR SUBSTRATE DECURLER INITIALIZATION AND SETUP

(75) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/173,403

(22) Filed: Jun. 30, 2011

(65) Prior Publication Data

US 2013/0001868 A1 Jan. 3, 2013

(51) Int. Cl.
*B65H 5/02* (2006.01)
*G03G 15/00* (2006.01)

(52) U.S. Cl.
CPC ..... *G03G 15/6558* (2013.01); *G03G 15/6576* (2013.01)

(58) Field of Classification Search
CPC .... B65H 29/70; B65H 2553/24; B65H 29/12; B65H 2401/21; B65H 2401/211; B65H 5/025; B65H 5/062; B65H 5/064; B65H 5/06
USPC ..... 271/188, 209, 314, 273, 274, 272; 399/406, 390, 341
See application file for complete search history.

(56) References Cited

U.S. PATENT DOCUMENTS

| | | | | |
|---|---|---|---|---|
| 3,637,305 | A * | 1/1972 | Tanaka et al. | 399/386 |
| 5,458,324 | A | 10/1995 | Nakamura et al. | |
| 5,499,807 | A | 3/1996 | Nakamura et al. | |
| 5,848,347 | A * | 12/1998 | Kuo et al. | 399/406 |
| 6,259,888 | B1 * | 7/2001 | Kazama et al. | 399/406 |
| 6,282,403 | B1 * | 8/2001 | Spencer et al. | 399/406 |
| 6,603,954 | B1 * | 8/2003 | Zoltner et al. | 399/405 |

* cited by examiner

*Primary Examiner* — Thomas Morrison
(74) *Attorney, Agent, or Firm* — Ronald E. Prass, Jr.; Prass LLP

(57) ABSTRACT

A decurler system includes a metallic penetrating roll and a conductive elastomeric idler roll that is movable from an open position to a contact position. The penetrating member is connected to an electrical power supply. When the idler roll contacts the penetrating roll, the idler roll conducts electrical power supplied to the penetrating roll. An initialization process includes detecting an electrical current conducted by the idler roll to determine that an idler roll is in a contact position. An idler roll wear is monitored by counting a number of steps that the idler roll is driven before an electrical current is detected at the idler roll.

3 Claims, 4 Drawing Sheets

METHODS, APPARATUS, AND SYSTEMS FOR SUBSTRATE DECURLER INITIALIZATION AND SETUP

FIELD OF DISCLOSURE

The disclosure relates to methods, apparatus, and systems for initializing a decurler apparatus and/or system. In particular, the disclosure relates to methods, apparatus, and systems for initializing and setting up a decurler system having conductive rollers.

BACKGROUND

Substrate processing systems such as, for example, printers and photocopiers may include a decurler system for inducing or reducing a curl of a substrate such as a paper cut sheet. Decurler systems may include one or more elastomeric rolls and a penetrating roll for forming or reducing an indentation or curl in a substrate. The penetrating roll must be accurately placed to induce or reduce a desired curl.

An algorithm may be used to iteratively bring an elastomeric idler roll toward and/or in contact with a penetrating roll, and to measure a period of motion of the idler roll to determine whether a desired contact and/or indentation has been made, i.e. whether the idler roll has reached home. An exemplary related art decurler initialization process that relies on multiple iterations to find a contact position is disclosed in U.S. Pat. No. 6,282,403, the entire disclosure of which is incorporated herein by reference in its entirety.

SUMMARY

Related art decurler initialization tends to be time-consuming and unreliable. Specifically, because the algorithm relies on measuring a period of motion, and because the idler motion includes rotating the idler a large number of degrees, an initialization time can last as long as about 30 seconds. To reduce the initialization time, the overall initialization process may be shortened by skipping initialization of at least one idler roll in a system having multiple idler rolls and/or decurler apparatus. Such measures have been found to compromise reliability of decurler systems in substrate processing systems because at least one decurler may not be completely initialized. Further, it has been found that a stepper motor controlling an idler motion in a related art decurler system may not consistently or reliably hold position due to current holding issues.

Decurler methods, apparatus and systems are disclosed that accommodate an improved initialization time, and initialization that is more accurate and reliable. Methods of an embodiment include a decurler initialization method, comprising driving a conductive elastomeric idler member from a home position to a contact position, wherein the idler member contacts a penetrating member at the contact position. Methods include applying electric power to the penetrating member, which includes a metallic surface. In an embodiment, methods include detecting a current to determine that the idler member is in a contact position wherein the electric power applied to the penetrating member is conducted by the elastomeric idler member.

In an embodiment, methods include applying electric power to the penetrating member before the conductive elastomeric idler member reaches a contact position. Methods include determining that decurler initialization is complete when a current flowing from the penetrating member to the conductive elastomeric idler member is detected. In another embodiment, methods may include counting a number of steps required to drive the conductive idler member from a home position to a contact position, the idler member being connected to a cam and a stepper motor that drives the idler member. Methods include comparing the counted number of steps with a predetermined number of steps to determine an amount of idler member wear.

In an embodiment, decurler apparatus may comprise a penetrating member, the penetrating member being connected to a power source. Apparatus may include an elastomeric idler member, the idler member being conductive. A surface of the elastomeric idler member may comprise urethane. The conductive urethane surface may be configured to prevent or minimize marking of a substrate passing through the decurler apparatus. The penetrating member may include a metallic surface. A stepper motor may be configured to drive the idler member to move the idler member from a home position to a contact position wherein the idler member contacts the penetrating member.

In an embodiment, apparatus may include at least one cam, the cam being connected to a stepper motor and the idler member, the stepper motor being configured to drive the at least one cam to move the idler member. The a stepper motor may be configured to step the idler member toward the penetrating member; and a sensor configured to detect a step made by the idler member, the idler member being driven by the stepper motor. In another embodiment, a controller may be configured to determine idler member wear by counting one or more steps detected by the sensor, and comparing a predetermined step count with the counted number of steps detected by the sensor.

In an embodiment, systems may include a printing system comprising a substrate transport system that transports a substrate through the printing system; a power supply that provides an electrical current to the decurler system; and a decurler system comprising a penetrating member and an idler member, a surface of the idler member being conductive, the power supply being connected to the penetrating member. Systems may include a drive system comprising a motor and a cam system, the cam system being operably configured to step the idler member from a home position to a contact position wherein a current flows through the idler member and the penetrating member, the cam system being powered by the motor.

In another embodiment, an elastomeric idler member wear measurement system that detects a number of steps from a home position that the idler member is driven by the drive system, the wear measurement system comprising a sensor adapted to detect steps and a controller adapted to count the steps detected by the sensor. In an embodiment, systems may include a spring loaded conductive follower, the conductive followed being arranged to contact the idler member.

In an embodiment, systems may include a current sensor for detecting a current conducted by the idler member when the idler member is in a contact position with respect to the penetrating member. In an embodiment, the penetrating member comprises a cylindrical metallic roll, the roll being rotatable about a longitudinal axis of the roll, and the idler member comprises a cylindrical roll having a conductive elastomeric surface, the idler roll being rotatable about a cylindrical axis and having a diameter that is greater than a diameter of the penetrating roll.

Exemplary embodiments are described herein. It is envisioned, however, that any systems that incorporate features of methods, apparatus, and systems described herein are encompassed by the scope and spirit of the exemplary embodiments.

DETAILED DESCRIPTION

Figure 1A:
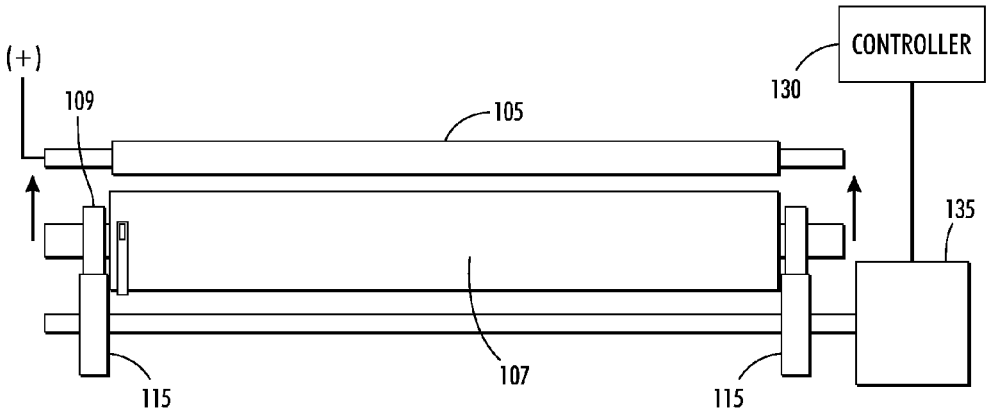
FIG. 1A shows a diagrammatical front view of a decurler having a penetrating drive roll and a conductive elastomeric idler roll in accordance with an exemplary embodiment.

Exemplary embodiments are intended to cover all alternatives, modifications, and equivalents as may be included within the spirit and scope of the methods, apparatus, and systems as described herein.

Reference is made to the drawings to accommodate understanding of methods, apparatus, and systems for inducing a curl in a substrate or decurling a substrate such as a cut sheet. In the drawings, like reference numerals are used throughout to designate similar or identical elements. The drawings depict various embodiments and data related to embodiments of illustrative methods, apparatus, and systems.

In typical related art initialization methods, apparatus, and systems, an idler roll is iteratively rotated as the idler roll is driven from a home position to a contact position. A step count is calculated to determine if roll contact is complete. The process may take as long as 30 seconds to complete. In systems having more than one decurler, related art methods, apparatus, and systems include skipping initialization of one of each of the decurler each time an initialization operation is carried out. It has been found that this results in incomplete initialization. Further, the stepper controlling motion of the idler roll in such systems does always hold position due to current holding issues.

In systems wherein an elastomeric idler roll is used in combination with a penetrating roll to induce or reduce a curl in a sheet, the penetrating roll must be accurately placed to accomplish a desired curl. Related art systems use an algorithm to iteratively move the idler roll into contact with the penetrating roll and the system measures the period of motion of the idler roll to determine if the proper contact and/or proper indentation have been made.

Because the algorithm relies on measuring a period of motion, the time to complete such related art initialization routines is substantial. Substantial initialization times may negatively affect overall system start-up times. Related art efforts to address such issues include alternately initializing decurler rolls in systems having decurler apparatus. Such methods have been found to result in improper initialization because some decurlers are not initialized. It has been found that a holding current on decurler steppers may not ensure consistent positioning and may lead to inaccurate decurler positioning when some decurlers are not initialized because decurler position relies on a calculated distance from an initialization or start position, or point where the penetration member is in contact with the idler member.

Accurate and complete initialization may be achieved with reduced initialization times using methods, apparatus, and systems for inducing or reducing a curl in a substrate in accordance with embodiments. Specifically, embodiments rely on detecting electrical continuity by implementing a conductive elastomeric layer in an idler roll, and applying electrical power to a metallic penetrating roll so that an electric current may be detected when the metallic penetrating roll contacts the conductive elastomeric idler roll. Because contact is determined by electrical continuity rather than a rotational period of a urethane idler roll as in related art systems, the idler roll may be moved quickly into position without a need for waiting for the urethane roll to rotate a number of steps to confirm contact.

Urethane idler members are provided by MEARTHANE, INC. MEARTHANE also provides electrically conductive rolls that are capable of providing a suitable Urethane with both electrically conductive properties and non-marking properties for use in methods, apparatus, and systems in accordance with embodiments. Decurler methods, apparatus, and systems in accordance with embodiments may be implemented in printers, for example, or any systems requiring decurler roll or elastomeric rolls that require setup or initialization due to tolerance build up or setup requirements.

Systems and apparatus in accordance an exemplary embodiment include using a conductive decurler member, e.g., a roll, to identify decurler initialization position by way of electrical continuity or conductivity. Methods in accordance with an exemplary embodiment include a decurler initialization and setup procedure that uses electrical conductivity to identify initialization location, eliminating the need to step through penetration while rotating the elastomeric roll to confirm contact. Methods include using a metallic penetrating roll and a conductive elastomeric idler roll to create electrical contact for initialization and setup. Further, because a distance to roll contact may be determined by counting steps to a contact point, roll wear may be detected and determined.

Systems, apparatus, and methods accommodate reduced initialization times by eliminating the need to locate the penetrating member and rotate the elastomeric roll to confirm proper engagement to adjust the home setup position. Conductive rolls have an added benefit of discharging substrates such as paper during a decurl operation.

FIG. 1A shows a decurler in accordance with apparatus and systems. Specifically, FIG. 1A shows a decurler apparatus having a penetrating roll 105. The penetrating roll 105 comprises a metallic layer that is configured for electrical connection to a power source. The penetrating roll 105 may comprise, for example, stainless steel or electro-plated cold rolled steel.

An idler roll 107 may be configured to contact the penetrating roll 105 to induce or reduce an indentation or curl in a substrate. The idler roll 107 may have a diameter that is greater than a diameter of the penetrating member 105. The idler member or idler roll 107 may be movable between an open position and a contact position. For example, FIG. 1A shows a cam follower 109 engaged with the idler member 107. FIG. 1A shows at least one cam 115. A spring loaded conductive follower 125 may be configured to contact the elastomeric idler roll 107. The conductive follower 125 may be configured to contact the conductive idler member to complete the electrical circuit when the penetrating member 105 contacts the conductive idler member 107. The spring loaded conductive follower 125 may be grounded. The in board and out board cams 115 are connected to the cam follower 109. The cams 115 are rotatable by way of a stepper motor 135.

The idler roll or idler member 107 may be movable from a home or open position to a contact position wherein the idler member contacts the penetrating member 105. FIG. 1A shows the idler member 107 in an open position wherein the idler member 107 does not contact the penetrating member 105. When the idler roll 107 contacts the penetrating member 105, the idler roll 107 may conduct electrical current from the penetrating roll 105, which is powered by the power source (not shown). A controller 130 is configured to count the number of steps required to step the idler roll 107 to the contact position during initialization to determine how many steps to move the idler roll 107 for decurling at the contacting position.

Figure 1B:
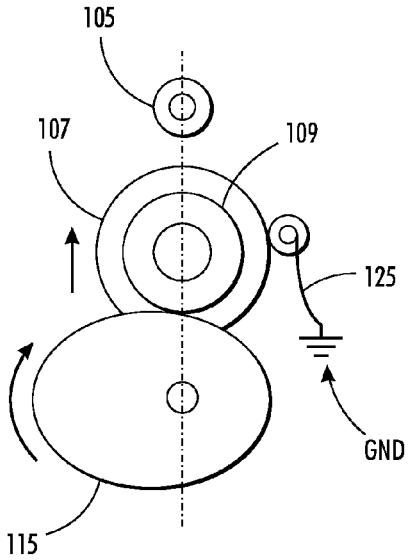
FIG. 1B shows a diagrammatical cross-sectional side view of the decurler shown in FIG. 1A.

FIG. 1B shows a side cross-sectional view of the decurler apparatus of FIG. 1A. Specifically, FIG. 1B shows the penetrating roll 105 and the idler roll 107 in an open, e.g., a home position. A cam follower 109 is engaged with the idler roll 107, and contacts the cam 115. The cam 115 may be driven to step the idler roll 107 toward the penetrating roll 105 to contact the penetrating roll 105 to enable electrical continuity between the metallic penetrating roll 105 and the elastomeric conductive idler roll 107.

Figure 2A:
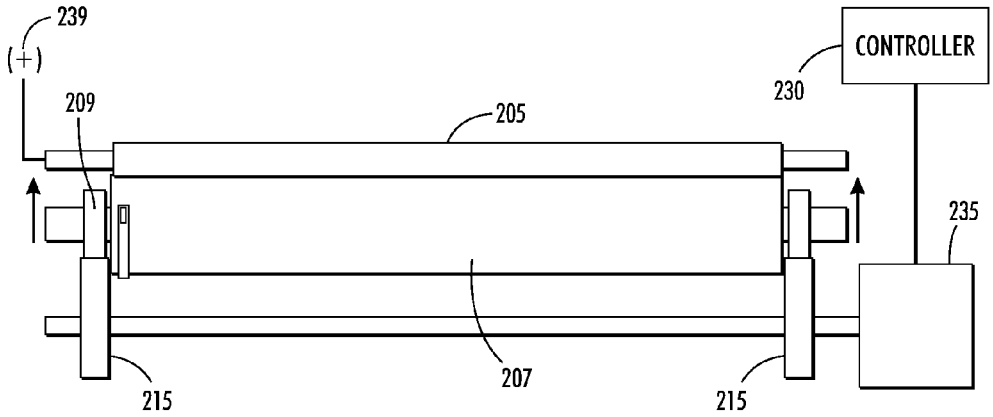
FIG. 2A shows a diagrammatical front view of a decurler having a penetrating drive roll and a conductive elastomeric idler roll in accordance with an exemplary embodiment.

FIG. 2A shows a decurler apparatus in accordance with apparatus and systems. Specifically, FIG. 2A shows a decurler apparatus having a penetrating roll 205. The penetrating roll 205 comprises a metallic layer that is configured for electrical connection to a power source 239. The penetrating roll 205 may comprise, for example, stainless steel or electro-plated cold rolled steel.

An idler member such as idler roll 207 may be configured to contact the penetrating roll 205 to induce or reduce an indentation or curl in a substrate. The idler roll 207 may have a diameter that is greater than a diameter of the penetrating roll 205. The idler member or idler roll 207 may be movable. For example, FIG. 2A shows a cam follower 209 engaged with the idler member 207. FIG. 2A shows at least one cam 215. A spring loaded conductive follower 225 may be configured to contact the elastomeric idler roll 207. The spring loaded conductive follower 225 may be grounded. The in board and out board cams 215 are connected to the cam follower 209. The cams 215 are rotatable by way of a stepper motor 235.

The idler roll 207 may be movable from a home or open position to a contact position wherein the idler member or idler roll 207 contacts the penetrating member 205. FIG. 2A shows the idler member 207 in a contact position wherein the idler member 207 contacts the penetrating member 205. In the contact position, electrical power supplied to the penetrating member 205 may be conducted by the idler member 207. The electrical continuity may be detected to determine that the idler member 207 is in the contact position. A controller 230 is configured to count the number of steps required to step the idler roll 207 to the contact position during initialization to determine how many steps to move the idler roll 207 for decurling at the contacting position.

Figure 2B:
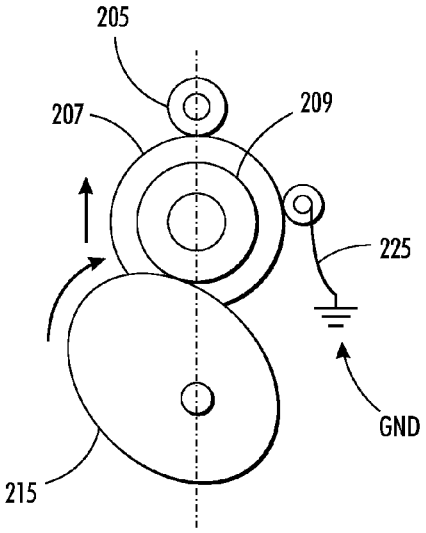
FIG. 2B shows a diagrammatical cross-sectional side view of the decurler shown in FIG. 2A.

FIG. 2B shows a side cross-sectional view of the decurler apparatus of FIG. 2A. Specifically, FIG. 2B shows the penetrating roll 205 and the idler roll 207 in a contact position. A cam follower 209 is engaged with the idler roll 207, and contacts the cam 215. The cam 215 may be driven to step the idler roll 207 toward the penetrating roll 205 to contact the penetrating roll 205 to enable electrical continuity between the metallic penetrating roll 205 and the elastomeric conductive idler roll 207.

Figure 3:
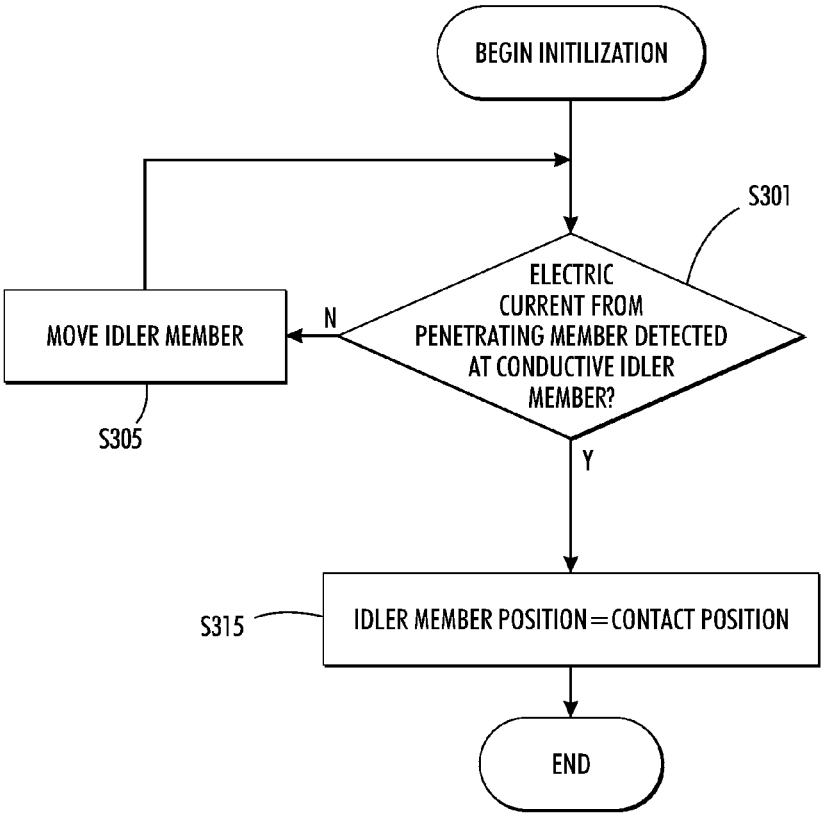
FIG. 3 shows a decurler initialization process in accordance with an exemplary embodiment.

FIG. 3 shows a decurler initialization process in accordance with an embodiment of methods. Specifically, FIG. 3 shows an initialization process that includes beginning initialization, and at S301 detecting an electrical current conducted by a conductive idler member from a penetrating member that is powered by a power source. The penetrating member may be a metallic penetrating roll, for example. The idler member may be a conductive elastomeric roll that is configured to induce or reduce an indentation or curl in a substrate with the penetrating roll. W If an electric current is not detected at S301, then the idler member may be moved at S305. Then, the initialization process may return to S301 for detecting an electric current. If an electric current is detected at S301, the process proceeds to S315 for determining that the current idler member is the contact position.

Figure 4:
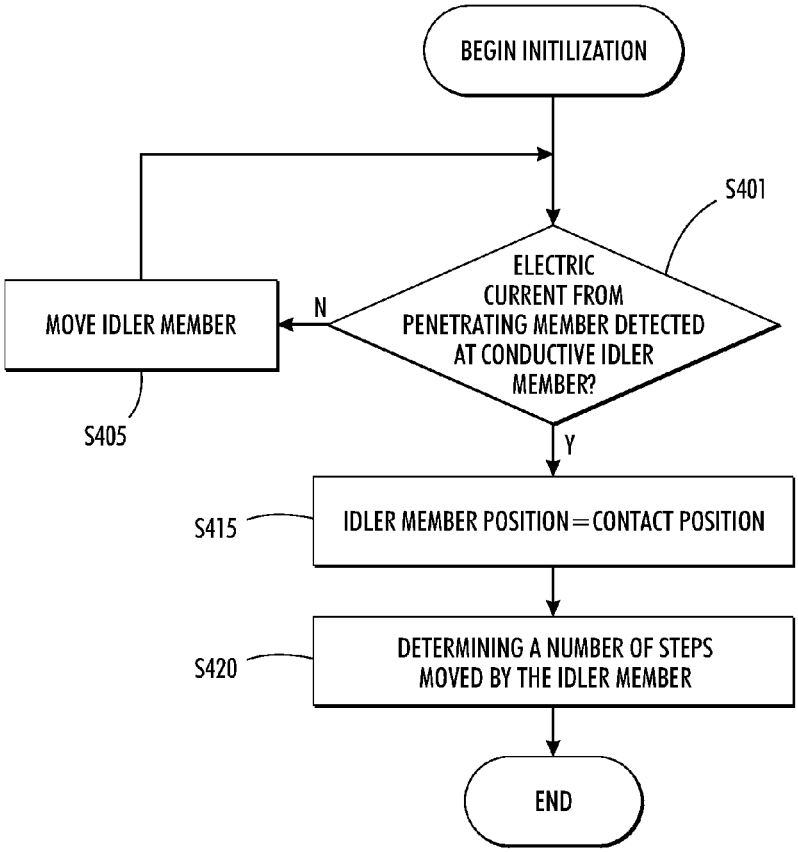
FIG. 4 shows a decurler initialization process and idler member wear measurement process in accordance with an exemplary embodiment.

FIG. 4 shows an initialization process in accordance with an embodiment of methods. Specifically, FIG. 4 shows an initialization process that includes beginning initialization, and at S401 detecting an electrical current flowing from penetrating member and conductive idler member, e.g., a conductive urethane roll, by a conductive follower member. The penetrating member maybe a metallic penetrating roll, for example. The idler member may be a conductive elastomeric roll that is configured to induce or reduce an indentation or curl in a substrate with the penetrating roll.

If an electric current is not detected at S401, then the idler member may be moved at S405. Then, the initialization process returns to S401 for detecting an electric current. If an electric current is detected at S401, the process proceeds to S415 for determining that the current idler member is the contact position.

Methods include gathering data for determining idler member wear at S420 by determining a number of steps moved by the idler member. Specifically, a number a steps moved by the idler member at S405 from a home position may be counted. An initial location of the idler member is known, and the amount of steps of movement required to bring the idler member into electrical contact with the penetrating member may vary according to a thickness, and therefore wear of the roll.

While methods, apparatus, and systems for decurler apparatus and system initialization and setup are described in relationship to exemplary embodiments, many alternatives, modifications, and variations would be apparent to those skilled in the art. Accordingly, embodiments of methods, apparatus, and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A printing system, comprising:

a substrate transport system that transports a substrate through the printing system;

a decurler system comprising a penetrating member and an idler member, a surface of the idler member being conductive, the decurler system being configured to impart curl in the substrate;

a power supply that provides an electrical power to the decurler system, the power supply being connected to the penetrating member;

a drive system comprising a motor and a cam system, the cam system being operably configured to step the idler member from a home position at which an electrical current flowing through the idler member and the penetrating member is discontinued, until the idler member reaches a contact position at which the electrical current flows through the idler member and the penetrating member, the cam system being powered by the motor; and a controller, the controller being configured to count a number of steps required to step the idler member to the contact position during initialization to determine how many steps to move the idler member for decurling at the contacting position.

2. The system of claim 1, the decurler system further comprising:

a spring loaded conductive follower, the conductive follower being arranged to contact the idler member.

3. The system of claim 1, wherein the penetrating member comprises a cylindrical roll, the cylindrical roll being rotatable about a longitudinal axis of the cylindrical roll, and the idler member comprises another cylindrical roll, the other cylindrical roll being rotatable about a cylindrical axis and having a diameter that is greater than a diameter of the cylindrical roll of the penetrating member.

* * * * *